United States Patent [19]

Bailey

[11] 4,052,047

[45] Oct. 4, 1977

[54] CLAMP

[75] Inventor: Edward A. Bailey, Newport, N.H.

[73] Assignee: Joy Manufacturing Company, Pittsburgh, Pa.

[21] Appl. No.: 657,508

[22] Filed: Feb. 12, 1976

[51] Int. Cl.[2] ..... B25B 1/24

[52] U.S. Cl. ..... 269/238; 81/53.2; 269/270

[58] Field of Search ..... 269/237, 238, 268–270; 81/53.2

[56] References Cited

U.S. PATENT DOCUMENTS

| | | | |
|---|---|---|---|
| 2,221,923 | 11/1940 | Passaver | 269/269 |
| 2,681,582 | 6/1954 | Valvano | 81/53.2 |

*Primary Examiner*—Robert C. Watson
*Attorney, Agent, or Firm*—J. Stewart Brams

[57] ABSTRACT

Improved clamping or gripping means particularly for gripping an elongated formed member.

12 Claims, 6 Drawing Figures

CLAMP

In the art earth drilling it is well known to provide drilling rigs including clamp or grip means for manipulating elongated drill steel sections. For example, various such clamps have regularly been used for the assembly or disassembly of an elongated drill string formed from a plurality of such drill steel sections releasably joined end to end, as exemplified by U.S. Pat. Nos. 3,411,596, 3,633,771, and 3,506,075 among many others. Although the drill steel clamps and grips known heretofore have generally served the purposes intended, many have nevertheless been subject to certain deficiencies and disadvantages. For example, difficulties have been encountered in providing a clamp able to grip a drill steel section firmly enough to resist rotation thereof upon torquing by the drill motor to break or make up a threaded connection therebetween. In the prior art such difficulties have commonly been overcome by forming wrench flats on the drill steel during manufacture to provide a suitable gripping surface for available conventional wrenches. This solution has not proven entirely satisfactory in that it increases the drill steel manufacturing cost and is operable only in selected rotary positions of the drill steel thus complicating drill operation. Additionally, such wrench flats have precluded the use of certain desirable drill steel structures such as continuously threaded drill steels.

These and other deficiencies of the prior art are overcome by the present invention which provides clamp or grip means well suited to clamp and hold a threaded or circumferentially grooved portion of a drill steel in any rotary position thereof without significant deformation of the threads or grooves, and with a mechanical advantage which readily provides sufficient frictional force between the drill steel and clamp jaw to firmly hold the drill steel against rotation during makeup or break-out of drill string connections. The present invention thus obviates the need for such prior devices as wrench assemblies cooperable with formed wrench flats on the drill steel.

These and other objects and advantages of the instant invention are more fully specified in the following description with reference to the accompanying figures, in which.

Figure 1:
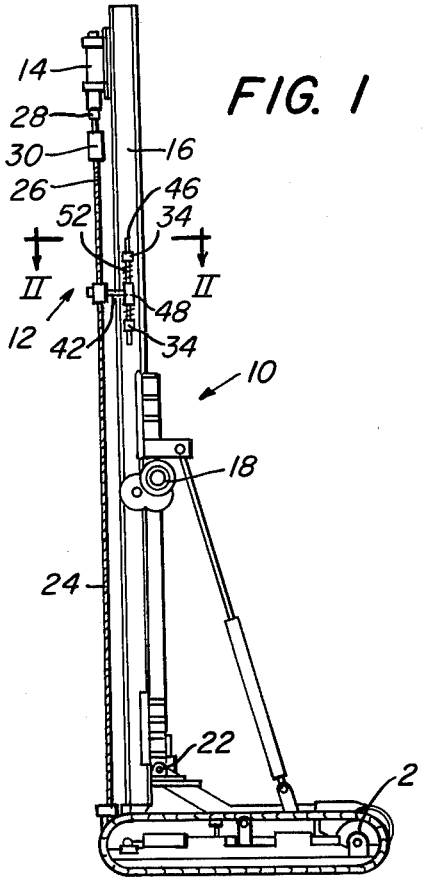
FIG. 1 is a side elevation of a drilling rig embodying a drill steel clamp means of the present invention.

There is generally indicated at 10 in FIG. 1 a rock drilling rig including a drill rod clamp means 12 constructed in accord with the principles of the present invention. Of course it is to be understood from the outset that clamp 12 may be adapted for use with any of a wide variety of drilling rigs of which drill 10 is but one exemplary type well known in the art of rock drilling. Accordingly, the particular structure of drill 10 is not to be construed as limiting upon the invention described herein. Imasmuch as the drill 10 is of a well known type, detailed description thereof is omitted herefrom. Suffice it to note in this regard that the drill 10 generally comprises a drill motor 14 powered by any suitable motive power means (not shown) and mounted for controlled movement longitudinally of a generally upstanding, elongated boom 16. Boom 16 includes feed means such as a feed chain mechanism partially shown at 18 and cooperable with the boom 16 for controlled feeding of motor 18 upwardly and downwardly therealong as viewed in FIG. 1.

The boom 16 may be adjustably, pivotally carried by any suitable mobile base such as a powred crawler frame 20 whereby drill 10 is adapted for controlled traverse of the ground to position the boom 16 for drilling. The pivotal connections of boom 16 to frame 20, as at 22 for example, permit adjustment of the boom 16 about true vertical as required by uneven terrain or for the purpose of drilling off-vertical holes.

For purposes of simplified description hereinbelow the term longitudinal will refer to the longitudinal extent of boom 16, and the terms transverse and lateral will refer to directions transverse or lateral to such longitudinal extent.

During drilling operations the drill motor 14 is actuated by the power means therefor (not shown) and is fed downwardly along boom 16 by actuation of feed means 18 to drill a hole into the underlying earth formation with an elongated drill string 24 comprised of at least one elongated drill steel 26 rigidly, releasably affixed adjacent one longitudinal end thereof to a striking bar 28 of motor 14 as by a coupling 30. A well known drill bit (not shown) is affixed adjacent the opposed end of drill string 24. Of course in common practice the drill string 24 may be assembled as drilling proceeds from a plurality of the drill steels 26 joined end to end by additional couplings 30, each of which may be formed as an internally threaded sleeve member adapted to engage cooperably threaded external end portions of drill steels 26 in torque and axial force transmitting engagement. It is to be understood that the invention herein may be applied generally to any drilling apparatus or operation wherein it is desired to firmly grip a threaded or circumferentially grooved portion of a drill steel to preclude rotation thereof, and therefore the particular described structures of coupling 30 and drill steel 26, and the particular nature of the mechanical engagement therebetween are merely exemplary of one environment in which the present invention has proven advantageous.

Figures 2, 6:
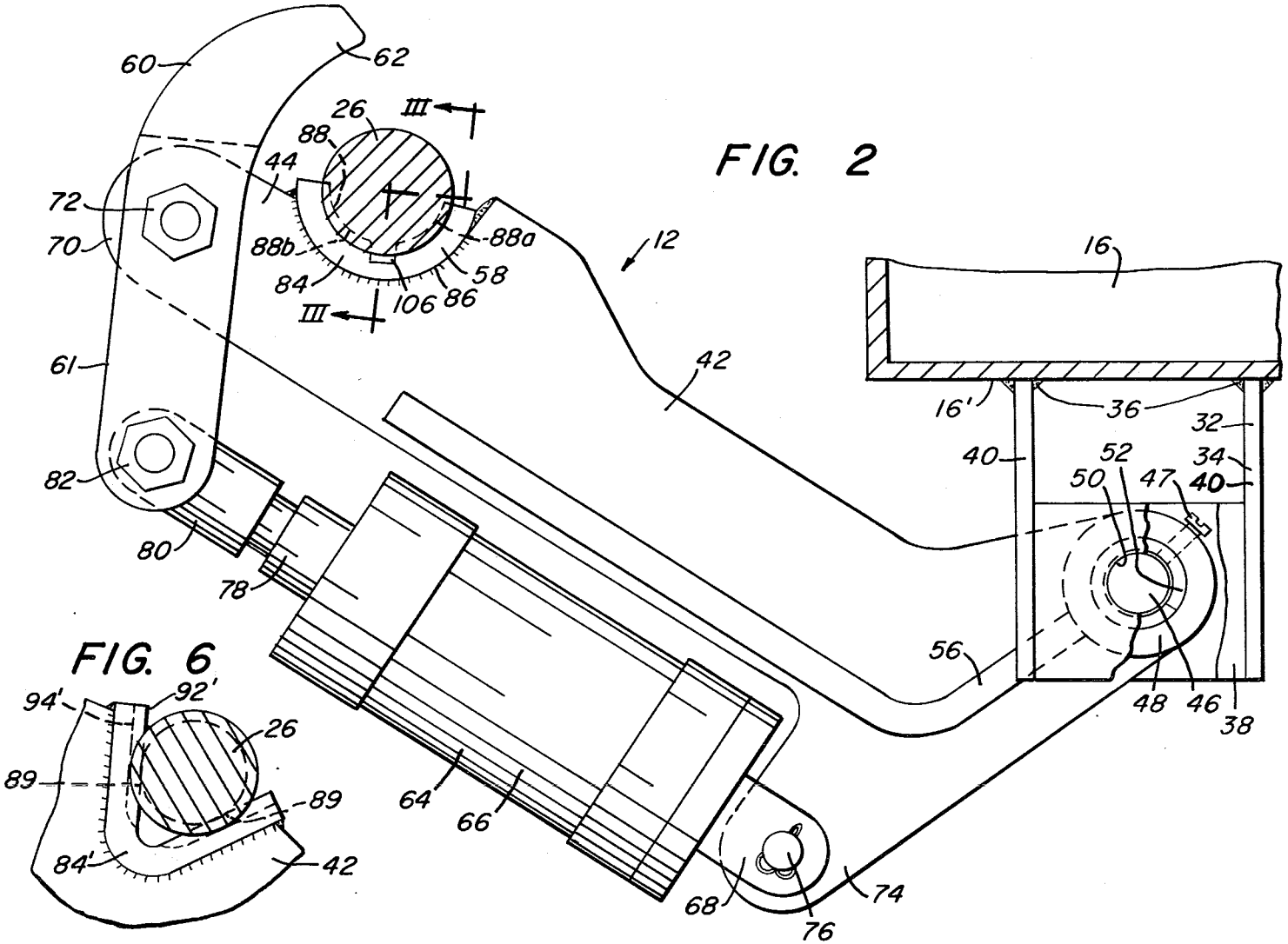
FIG. 2 is a top plan view of the clamp means of this invention as seen from line 2—2 of FIG. 1 and with portions thereof cut away.

Accordingly, the clamp means 12 (FIGS. 1, 2 and 3) is provided for firmly gripping a threaded or circumferentially grooved portion of a drill steel 26. Referring more particularly to FIGS. 1 and 2, the clamp means 12 is shown as an elongated clamp arm 42 pivotally carried by pivot mount means 32 adjacent one end thereof for pivotal motion with respect to boom 16 to swing a jaw portion 44 of arm 42 into and out of engagement with a threaded or grooved portion of a drill steel 26.

The arm 42 comprises an annular pivot member 48 rigidly affixed adjacent one end thereof and having an elongated pivot axis member 46 passing therethrough and rigidly affixed therewithin by any suitable means such as a set screw 47 for example. Axis member 46 extends outwardly from each end of member 48 and generally longitudinally with respect to boom 16 intermediate respective upper and lower pivot brackets 34 of pivot mount 32, each of which comprises a plate 38 (shown partially broken away in FIG. 2) extending transversely intermediate and rigidly affixed to laterally spaced gussets 40. The brackets 34 are rigidly affixed at longitudinally spaced locations adjacent a lateral side portion 16' of boom 16 as by weldments 36 such that a pair of through bores 50, one in each plate 38, are axially aligned to pivotally slidably receive therewithin the respective opposed ends of the axis member 46. The ends of axis member 46 extend entirely through and beyond the respective bores 50 such that arm 42 is disposed longitudinally intermediate the brackets 34 as shown in FIG. 1. Thus the arm 42 is movable by sliding travel of member 46 within bores 50 longitudinally of boom 16 for such purposes as longitudinal alignment thereof with the peripheral portions of drill steel 26 to be clamped thereby. Further reference to FIGS. 1 and 2 will reveal that pivot mounting 32 additionally comprises biasing means such as coil springs 52 coaxial with member 46 and extending intermediate member 48 and the respective plates 38 to urge the clamp arm 42 to a central position longitudinally intermediate the brackets 34. By compression thereof the respective springs 52 effectively absorb any vertically directed shock loads on the arm 42 such as may be caused for example by a vertical feeding force or thrust applied to a drill steel engaged within the jaws of clamp 12.

As shown in FIG. 2 the arm 42 extends laterally from pivot member 48, and may include suitable structural reinforcements such as gussets 56 rigidly affixed to arm 42 and pivot member 48 as deemed necessary for structural integrity of the clamp 12. The jaw portion 44 of arm 42 is comprised of a fixed jaw portion 58 positioned so as to be engageable with one of drill steels 26 (disposed upon the drilling axis) upon pivoting of the arm 42 in a clockwise direction (as viewed in FIG. 2), and a movable jaw member 60 suitably disposed for clamping drill steel 26 within the jaw 58 upon power actuation of jaw 60. Thus, as shown the jaw 60 comprises a unitary structure having a clamping portion 62 and an elongated clevis portion 61 which straddles an outermost end 70 of arm 42 and is suitably pivoted thereto as by a nut and bolt assembly 72 adjacent the clamp portion 62.

For actuation of jaw 60 suitable power means are provided, for example a fluid operable piston and cylinder assembly 64 which comprises a cylinder 66 having a clevis 68 adjacent one end thereof which straddles and is pivoted to a lug portion 74 of arm 42 at a point spaced from the pivot 72 as by a pivot pin 76. A piston rod 78 extends from the opposed end of cylinder 66 and includes a lug 80 which is pivoted as by a nut and bolt assembly 82 intermediate the legs of jaw clevis portion 61 adjacent the free end thereof. Accordingly, upon controlled actuation of the piston and cylinder assembly 64 the jaw 60 is pivoted about pivot 72 to move clamp 62 into or out of forceful engagement with the drill steel 26 positioned within jaw 58.

Figure 3:
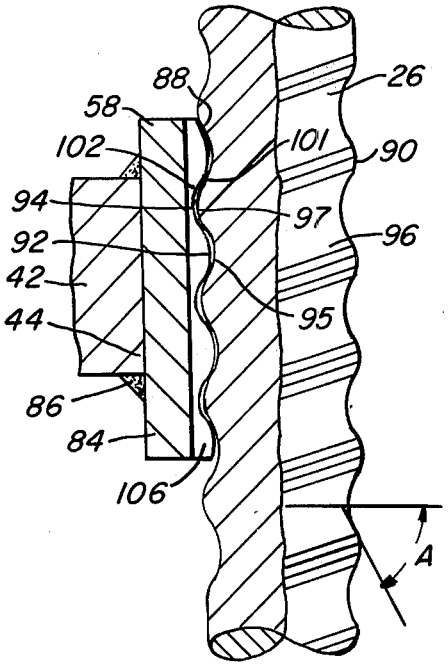
FIG. 3 is a partial sectional view taken on line 3—3 of FIG. 2.

With reference to FIGS. 2 and 3, the jaw 58 comprises a generally semi-cylindrical elongated body member 84 rigidly affixed adjacent portion 44 of arm 42 as by weldments 86 and having a concave and semi-cylindrical periphery 88 adapted to engage an externally threaded surface portion 90 of a drill steel 26 shown in FIG. 3 as a symmetrical rope thread 96 having a flank angle in the zone of contact with periphery 88 of, for example, 60° to 70° from a plane normal to the drill steel axis as indicated at A in FIG. 3. Another entirely suitable thread form is a so-caled modified acme thread with a flank angle of 55°.

Figure 5:
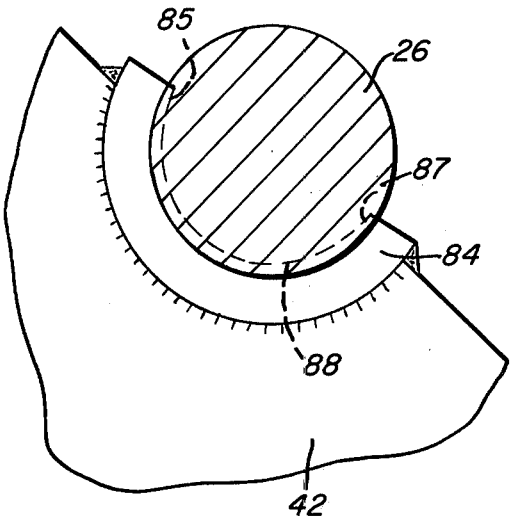
FIGS. 5 and 6 are similar fragmentary portions of FIG. 2, each showing a modified clamp jaw.
Figure 4:
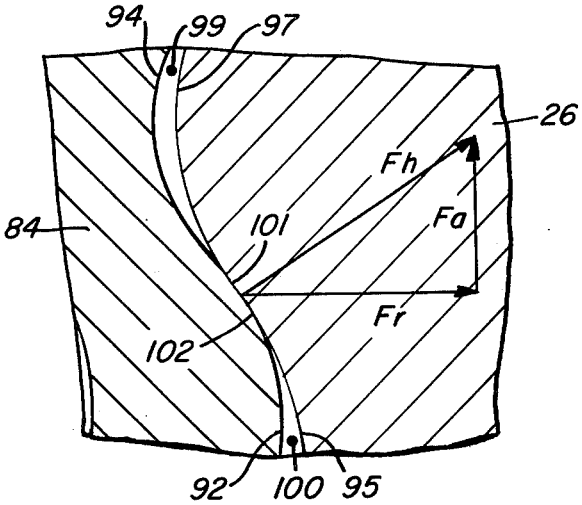
FIG. 4 is a fragmentary portion of FIG. 3 showing the engagement of a drill steel thread flank with the clamp jaw.

The periphery 88 has formed thereon means for gripping the threaded surface portion 90, which gripping means in the instant case will take the form of a plurality of internal thread-like lands 92 and alternate grooves 94 inclined to the axis of a jaw body 84 at the pitch angle of the rope thread 96 to be cooperable with respective roots 95 and crests 97 of thread 96. As shown in FIG. 4, each land 92 is truncated so as to provide a clearance 100 between the lands 92 and respective rope thread roots 95. Likewise, each groove 94 is undercut so as to provide a similar clearance 99 between the grooves 94 and respective rope thread crests 97. Thus, the lands 92 and grooves 94 are formed such that the only possible engagement between member 84 and the drill steel 26 is by contact of respective flank portions 101 and 102 of the thread 96 and the cooperably formed jaw periphery 88. Furthermore, the periphery 88 preferably has a longitudinally extending groove 106 formed thereon at a point opposite the clamping point of jaw 62 on steel 26. Groove 106 divides the periphery 88 into respective laterally spaced apart jaw surface portions 88a and 88b and is cut to a depth sufficient to preclude contact throughout the length thereof between any portion of the jaw 84 and the drill steel 26. The clamping forces between jaw 84 and steel 26 are thus advantageously distributed to the side portions 88a and 88b. An entirely feasible although less preferable semi-cylindrical jaw 84 is shown in FIG. 5 without the groove 106. This jaw form is considered to be somewhat less preferable than that first described because in the absence of groove 106 the clamping forces will tend to concentrate in the area opposite the clamping point of jaw 62 on steel 26. The jaw 84, with or without the longitudinal groove 106, may include chamfered end portions 85–87 (see FIG. 5) which serve to guide drill steel 26 into the jaw 84 during the clamping process.

Another suitable though less preferable jaw 58 is a generally V-shaped jaw memer 84' (FIG. 6) having respective lands 92' and grooves 94' cooperable with a grooved or threaded drill steel 26 as hereinabove described, and with an included angle between the jaw surfaces of from about 40° to about 90°, preferably 60°. Because clamping force will tend to concentrate in contact zones of very limited cross-sectional area defined generally as a point of tangency between the jaw surface and drill steel as shown at 89 in FIG. 6, there is a possibility of some localized thread deformation or other drill steel damage due to stress concentrations. Thus the V-shaped jaw is considered a less preferred jaw form.

Operation of the instant invention comprises pivoting arm 42 about pivot 46 as hereinabove described by any suitable power means (not shown), a powered rack and pinion mechanism or fluid powered piston and cylinder means for example, to engage the drill steel 26 within jaw 84. Upon application of a clamping force to the drill steel 26 by actuation of assembly 64 to grip the drill steel 26 between jaws 62–84, the lands 92 are wedged into respective roots 95 of thread 96 by forceful contact between respective flanks 102–101. The clamping force of the jaws 62–84, which is distributed over all such points of contact between flanks 102–101, may be represented as compressive force $F_r$ directed generally radially inward of the drill steel 26 as in FIG. 4. It will be seen however that $F_r$ may be resolved into an axial component $F_a$, and a normal component $F_n$ directed normal to the flanks 101–102 at the point of contact. The components $F_a$ and $F_n$ are shown in FIG. 4 in an axial plane for illustrative convenience. It will be appreciated that in the case of a threaded drill steel the $F_r$ and $F_a$ force components will in fact appear in a plane inclined to the drill steel axis by an angle equal to the thread pitch angle.

By application of basic trigonometry it will be seen that $F_n$ is greater than $F_r$ at all points of contact, and inasmuch as friction force between surfaces is directly related to the magnitude of the normal force component $F_n$, a mechanical advantage in gripping capability is realized by utilizing the inclined flank areas 101–102 for forceful contact between jaw 84 and steel 26. It will be appreciated that the flank angle A for both flanks 101–102 at the point of contact therebetween defines the magnitude of mechanical advantage to be achieved in that generally the smaller the flank angle A, the greater the mechanical advantage. Of course there are theoretical limits on the range of values for angle A in that at A = 90° the drill steel takes the form of a uniformly cylindrical bar and thus $F_r = F_n$ at all points of contact. Similar considerations apply at angle A = 0° (e.g., a square thread). Additionally, it is considered that as flank angle A approaches 0° the hereinabove described wedging action may produce far larger normal forces and hence far greater gripping friction than necessary with only a nominal radial clamping force $F_r$. It may be desirable to avoid such excess normal force because of possible damage to the drill steel threads. It has been determined that a flank angle of about 55° is quite suitable for practice of this invention although of course the invention is not intended to be limited thereby inasmuch as a wide range of flank angles within the theoretical limits defined hereinabove will suffice. For example, one practical range may be defined by the range of flank angles commonly found in threaded drill steels, or about 45° to 75°, although it is to be understood that the instant invention is not limited to this range of flank angles.

According to the foregoing description there is provided by the instant invention a longitudinally floating clamp means for gripping a threaded or otherwise formed drill steel portion in any rotary position thereof by mechanical contact between the clamp jaw and the drill steel in contact regions inclined to the drill steel axis in an axial plane at an angle between 0° and 90° so as to produce a mechanical advantage for increased gripping friction. The invention is particularly applicable to but not limited to a threaded drill steel and a cooperably threaded clamp jaw arrangement formed for flank to flank contact with such threaded drill steel.

Although the invention herein has been described in the context of a specific preferred embodiment, the invention in fact may be practiced in numerous alternative embodiments with various modifications thereto without departing from broad spirit and scope thereof. For example, the invention may be practiced with any of numerous threads such as an acme thread or other suitable threads, either symmetrical or non-symmetrical, with either single or multiple lead; alternatively, the gripping portion of the drill steel may take the form of a plurality of symmetrical or non-symmetrical circumferential lands and grooves; such grooves or threads may be formed upon an end portion, an intermediate portion, or the full length of the drill steel; the number of lands and grooves or threads on the clamp jaw for engaging the drill steel may be varied; a wide variety of power means may be utilized for driving the clamp 60 or arm 42; and the like. These and other embodiments and modifications having been envisioned and anticipated by the inventor, the invention should be interpreted broadly and limited only by the scope of the claims appended hereto.

What is claimed is:

1. In an apparatus for driving an elongated drill steel a drill steel clamping means comprising: support means carried by such an apparatus; jaw means carried by said support means and engageable in clamping engagement with such drill steel; said jaw means comprising at least a pair of relatively movable jaw members with at least one of said jaw members having a formed clamping surface portion engageable with an axially extending formed peripheral portion of such a drill steel; said formed clamping surface portion being comprised of axially spaced alternate land and groove portions and intervening inclined flank portions located axially intermediate said land and groove portions; and said clamping surface portion being engageable with such drill steel in clamping engagement constituted solely of engagement between said inclined flank portions and such formed peripheral portion.

2. A clamping means as claimed in claim 1 wherein the flank angle of said inclined flank portions in the range of about 45° to about 75°.

3. A clamping means as claimed in claim 2 wherein said flank angle is about 55°.

4. A clamping means as claimed in claim 1 wherein said formed clamping surface portion is engageable with circumferentially spaced portions of such formed peripheral portion.

5. A clamping means as claimed in claim 4 wherein said formed clamping surface portion comprises a pair of generally concave jaw surface portions engageable with said circumferentially spaced portions over a circumferential extent thereof.

6. A clamping means as claimed in claim 4 wherin said formed clamping surface portion is a pair of generally planar jaw surface portions, each engageable with one of said circumferentially spaced portions at a point of tangency thereto.

7. A clamping means as claimed in claim 6 wherein said generally planar jaw surface portions form an included angle therebetween in the range of about 40° to about 90°.

8. A clamping means as claimed in claim 7 wherein said included angle is about 60°.

9. A clamping means as claimed in claim 1 wherein said support means comprises an elongated arm carried by a pivot axis means cooperable with such apparatus for pivotal movement with respect thereto in a plane transverse to the axial extent of such drill steel, and for movement axially of said pivot axis means.

10. A clamping means as claimed in claim 9 additionally comprising biasing means cooperable with said pivot axis means for biasing the the movement of said arm axially of said pivot axis means.

11. A clamping means as claimed in claim 1 wherein said inclined flank portions are engageable with respective inclined flanks of threads formed by such formed peripheral portion.

12. A clamping means as claimed in claim 1 wherein said inclined flank portions are engageable with respective inclined flanks of circumferential grooves formed by such formed peripheral portion.

* * * * *